US006184836B1

(12) United States Patent
Ali

(10) Patent No.: US 6,184,836 B1
(45) Date of Patent: Feb. 6, 2001

(54) DUAL BAND ANTENNA HAVING MIRROR IMAGE MEANDERING SEGMENTS AND WIRELESS COMMUNICATORS INCORPORATING SAME

(75) Inventor: Mohammod Ali, Cary, NC (US)

(73) Assignee: Ericsson Inc., Research Triangle Park, NC (US)

( * ) Notice: Under 35 U.S.C. 154(b), the term of this patent shall be extended for 0 days.

(21) Appl. No.: 09/499,976

(22) Filed: Feb. 8, 2000

(51) Int. Cl.[7] ..... H01Q 1/24

(52) U.S. Cl. ..... 343/702; 343/895; 343/700 MS; 343/866

(58) Field of Search ..... 343/702, 700 MS, 343/895, 866, 870, 741, 867; H01Q 1/24

(56) References Cited

U.S. PATENT DOCUMENTS 5,966,097 * 10/1999 Fukasawa et al. ..... 343/700 MS
6,100,848 * 10/1999 Hayes ..... 343/702

OTHER PUBLICATIONS

Ali et al., "A Wide–Band Dual Meander–Sleeve Antenna," Journal of Electromagnetic Waves and Applications, vol. 10, pp. 1223–1236 (1996).

Ali et al., "Dual–Frequency Strip–Sleeve Monopole for Laptop Computers," IEEE Transactions on Antennas and Propagation, vol. 47, No. 2, pp. 317–323 (Feb. 1999).

Rowell et al., "A Capacitively Loaded PIFA for Compact Mobile Telephone Handsets," IEEE Transactions on Antennas and Propagation, vol. 45, No. 5, pp. 837–842 (May 1997).

Wong et al., "Height–Reduced Meander Zigzag Monopoles with Broad–Band Characteristics," IEEE Transactions on Antennas and Propagation, vol. AP–34, No. 5, pp. 716–717 (May 1986).

* cited by examiner

*Primary Examiner*—Hoanganh Le
(74) *Attorney, Agent, or Firm*—Myers Bigel Sibley & Sajovec

(57) ABSTRACT

Small antennas for internal mounting within wireless communicators, such as radiotelephones, that can operate within multiple frequency bands, including low frequency bands are provided. A planar radiating element overlies a pair of adjacent, spaced-apart, substantially parallel conductive strips that are electrically connected to ground. The conductive strips are configured to parasitically couple with the radiating element. The planar radiating element includes a first meandering segment and a second meandering segment that is a mirror image of the first meandering segment. The first meandering segment includes a set of periodically spaced-apart planar undulations, such as U-shaped portions, and the second meandering segment includes a corresponding set of periodically spaced-apart planar undulations. The first and second meandering segments are connected together in opposing relationship therewith to form a continuous, conductive loop.

19 Claims, 5 Drawing Sheets

DUAL BAND ANTENNA HAVING MIRROR IMAGE MEANDERING SEGMENTS AND WIRELESS COMMUNICATORS INCORPORATING SAME

FIELD OF THE INVENTION

The present invention relates generally to antennas, and more particularly to antennas used with wireless communications devices.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems. Radiotelephones typically include an antenna for transmitting and/or receiving wireless communications signals. Historically, monopole and dipole antennas have been widely employed in various radiotelephone applications, due to their simplicity, wideband response, broad radiation pattern, and low cost.

However, radiotelephones and other wireless communications devices are undergoing miniaturization. Indeed, many contemporary radiotelephones are less than 11–12 centimeters in length. As a result, there is increasing interest in antennas smaller than conventional monopole and dipole antennas that can be utilized internally within radiotelephones.

In addition, it is becoming desirable for radiotelephones to be able to operate within multiple frequency bands in order to utilize more than one communications system. For example, GSM (Global System for Mobile communication) is a digital mobile telephone system that typically operates at a low frequency band, such as between 880 MHz and 960 MHz. DCS (Digital Communications System) is a digital mobile telephone system that typically operates at high frequency bands, such as between 1710 MHz and 1880 MHz. The frequency bands allocated in North America are 824–894 MHz for Advanced Mobile Phone Service (AMPS) and 1850–1990 MHz for Personal Communication Services (PCS). Since there are two different frequency bands, radiotelephone service subscribers who travel over service areas employing different frequency bands may need two separate antennas unless a dual-frequency antenna is used.

Inverted-F antennas may be designed to fit within the confines of radiotelephones, particularly radiotelephones undergoing miniaturization. Unfortunately, conventional inverted-F antennas are typically narrow band and occupy more volume as compared with other types of antennas, such as helices, monopoles and dipoles. As such, a need exists for small, internal radiotelephone antennas that can operate within multiple frequency bands, including low frequency bands.

SUMMARY OF THE INVENTION

In view of the above discussion, the present invention provides small antennas for internal mounting within wireless communicators, such as radiotelephones, that can operate within multiple frequency bands, including low frequency bands. A pair of adjacent, spaced-apart, substantially parallel conductive strips are electrically connected to ground. A planar radiating element overlies the pair of conductive strips and is spaced-apart from the conductive strips in substantially parallel relationship. A dielectric material, such as a foamed material, may or may not be disposed between the conductive strips and the radiating element. The conductive strips are configured to parasitically couple with the radiating element.

The planar radiating element includes a first meandering segment and a second meandering segment that is a mirror image of the first meandering segment. The first meandering segment includes a set of periodically spaced-apart planar undulations, such as U-shaped portions, and the second meandering segment includes a corresponding set of periodically spaced-apart planar undulations. The first and second meandering segments are connected together in opposing relationship therewith to form a continuous, conductive loop. An RF signal feed is configured to electrically connect the planar radiating element with RF circuitry within a wireless communications device.

Antennas according to the present invention may be particularly well suited for use within a variety of communications systems utilizing different frequency bands. Furthermore, because of their small size, antennas according to the present invention may be easily incorporated within small communications devices. In addition, antenna structures according to the present invention may not require additional impedance matching networks.

DETAILED DESCRIPTION OF THE INVENTION

Figure 1:
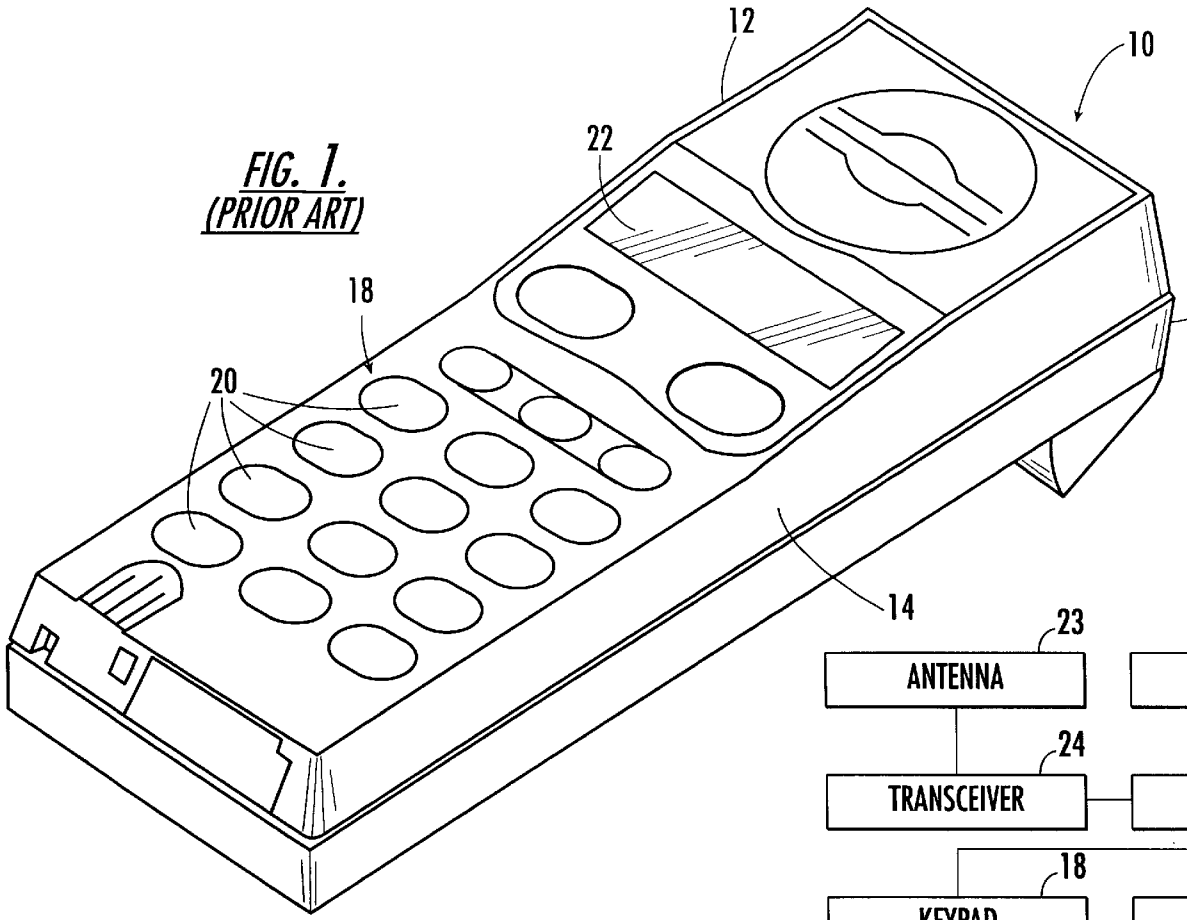
FIG. 1. (PRIOR ART)
FIG. 1 is a perspective view of an exemplary radiotelephone within which an antenna according to the present invention may be utilized.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions may be exaggerated for clarity. Like numbers refer to like elements throughout the description of the drawings. It will be understood that when an element such as a layer, conductive traces, region or substrate is referred to as being "on" another element, it can be directly on the other element or intervening elements may also be present. In contrast, when an element is referred to as being "directly on" another element, there are no intervening elements present.

Referring now to FIG. 1, a radiotelephone 10, within which antennas according to various embodiments of the present invention may be incorporated, is illustrated. The housing 12 of the illustrated radiotelephone 10 includes a top portion 14 and a bottom portion 16 connected thereto to form a cavity therein. Top and bottom housing portions 14, 16 house a keypad 18 including a plurality of keys 20, a display 22, and electronic components (not shown) that enable the radiotelephone 10 to transmit and receive radiotelephone communications signals.

Figure 2:
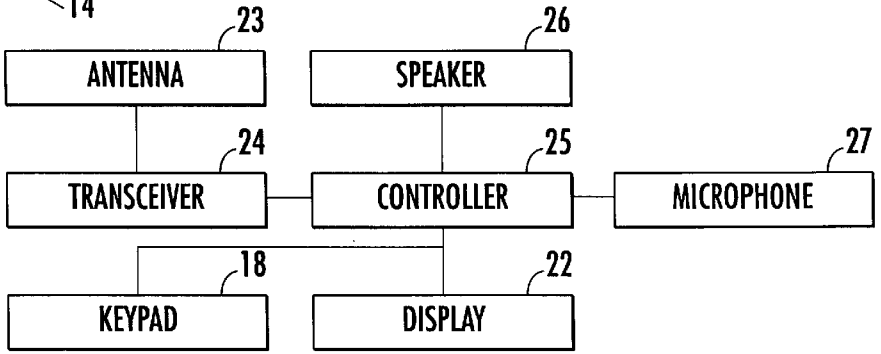
FIG. 2. (PRIOR ART)
FIG. 2 is a schematic illustration of a conventional arrangement of electronic components for enabling a radiotelephone to transmit and receive telecommunications signals.

A conventional arrangement of electronic components that enable a radiotelephone to transmit and receive radiotelephone communication signals is shown schematically in FIG. 2, and is understood by those skilled in the art of radiotelephone communications. An antenna 23 for receiving and transmitting radiotelephone communication signals is electrically connected to a radio-frequency transceiver 24 that is further electrically connected to a controller 25, such as a microprocessor. The controller 25 is electrically connected to a speaker 26 that transmits a remote signal from the controller 25 to a user of a radiotelephone. The controller 25 is also electrically connected to a microphone 27 that receives a voice signal from a user and transmits the voice signal through the controller 25 and transceiver 24 to a remote device. The controller 25 is electrically connected to a keypad 18 and display 22 that facilitate radiotelephone operation.

As is known to those skilled in the art of communications devices, an antenna is a device for transmitting and/or receiving electrical signals. A transmitting antenna typically includes a feed assembly that induces or illuminates an aperture or reflecting surface to radiate an electromagnetic field. A receiving antenna typically includes an aperture or surface focusing an incident radiation field to a collecting feed, producing an electronic signal proportional to the incident radiation. The amount of power radiated from or received by an antenna depends on its aperture area and is described in terms of gain.

Radiation patterns for antennas are often plotted using polar coordinates. Voltage Standing Wave Ratio (VSWR) relates to the impedance match of an antenna feed point with a signal feed line or transmission line of a communications device, such as a radiotelephone. To radiate radio frequency (RF) energy with minimum loss, or to pass along received RF energy to a radiotelephone receiver with minimum loss, the impedance of a radiotelephone antenna is conventionally matched to the impedance of a transmission line or feed point.

Conventional radiotelephones typically employ an antenna which is electrically connected to a transceiver operably associated with a signal processing circuit positioned on an internally disposed printed circuit board. In order to maximize power transfer between an antenna and a transceiver, the transceiver and the antenna are preferably interconnected such that their respective impedances are substantially "matched," i.e., electrically tuned to filter out or compensate for undesired antenna impedance components to provide a 50 Ohm (Ω) (or desired) impedance value at the feed point.

Figure 3A:
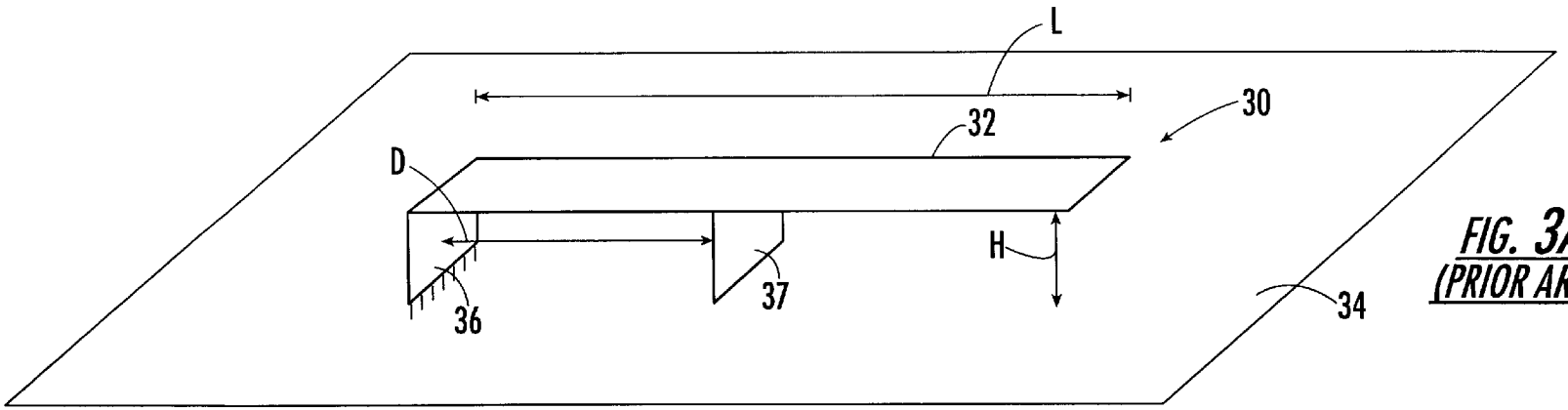
FIG. 3A. (PRIOR ART)
FIG. 3A is a perspective view of a conventional planar inverted F antenna (PIFA).
Figure 3B:
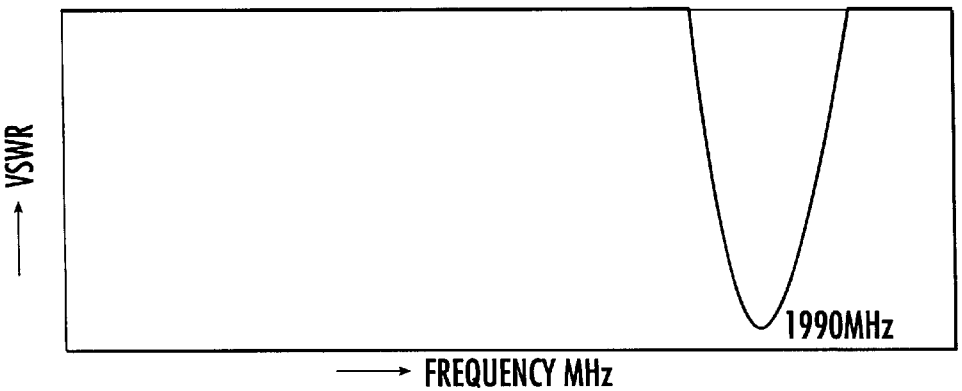
FIG. 3B is a graph of the VSWR performance of the PIFA of FIG. 3A.

Referring now to FIG. 3A, a conventional inverted-F antenna is illustrated. The illustrated antenna 30 includes a linear conductive element 32 maintained in spaced-apart relationship with a ground plane 34. Conventional inverted-F antennas, such as that illustrated in FIG. 3A, derive their name from a resemblance to the letter "F." The conductive element 32 is grounded to the ground plane 34 as indicated by 36. A hot RF connection 37 extends from underlying RF circuitry (not shown) through the ground plane 34 to the conductive element 32. FIG. 3B is a graph of the VSWR performance of the inverted-F antenna 30 of FIG. 3A. As can be seen, the antenna 30 resonates at about 2375 Megahertz (MHz).

Figure 4:
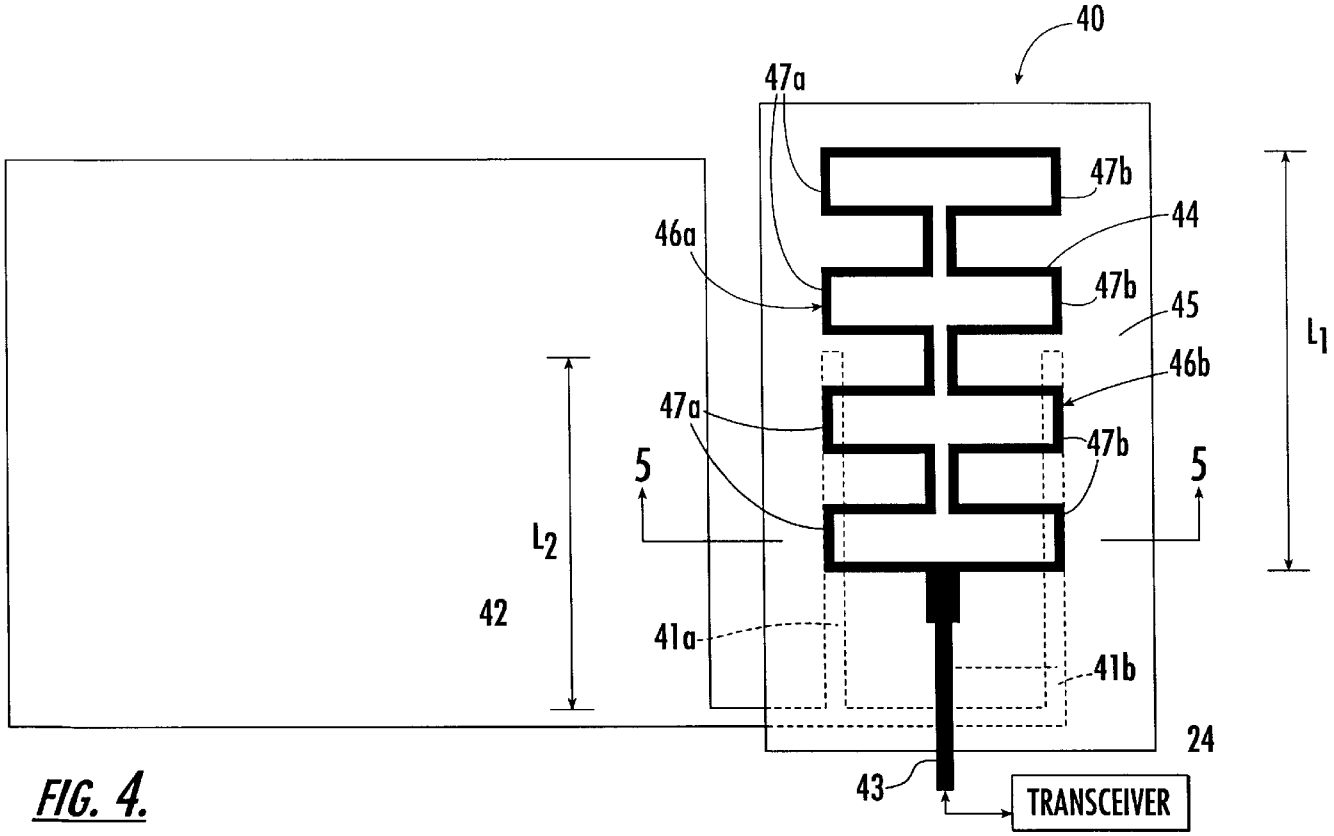
FIG. 4 is a top plan view of an antenna having a radiating element with mirror image meandering segments according to an embodiment of the present invention.
Figure 5:
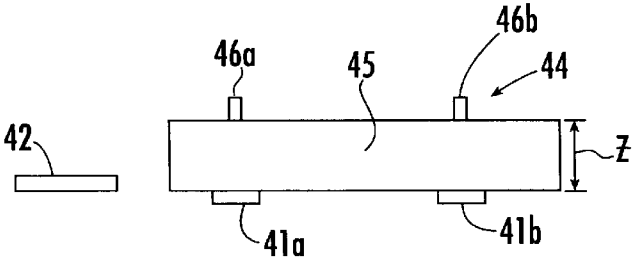
FIG. 5 is a section view of the antenna of FIG. 4 taken along lines 5—5.

Referring now to FIGS. 4 and 5, a dual-band antenna 40 according to an embodiment of the present invention is illustrated. The illustrated antenna 40 includes a pair of adjacent, spaced-apart, substantially parallel conductive strips 41*a*, 41*b* electrically connected to a ground plane 42. A planar radiating element 44 overlies the pair of conductive strips 41*a*, 41*b* and is spaced-apart from the pair of conductive strips 41*a*, 41*b*. The conductive strips 41*a*, 41*b* are configured to parasitically couple with the radiating element 44 to facilitate dual-frequency band operation. A signal feed 43 is provided to electrically connect the planar radiating element 44 to an RF transceiver 24 within a wireless communications device.

As is known to those skilled in the art, parasitic conductive elements are coupled to, and "feed off", near-field currents (i.e., currents flowing on a conductive surface exist in a "field" of electromagnetic fields that the currents induce in close proximity to the conductive surface). A parasitic conductive element is not driven directly by an RF source, but rather, is excited by energy radiated by another source. The presence of a parasitic conductive element may change the resonant characteristics of a nearby conductive element serving as an antenna. Accordingly, the conductive strips 41*a*, 41*b* are configured to electrically couple with the radiating element 44 such that the antenna 40 resonates at two separate and distinct (i.e., low and high) frequency bands.

The planar radiating element 44 may be maintained in overlying, spaced-apart relationship with the pair of conductive strips 41*a*, 41*b* via a dielectric material 45 disposed between the planar radiating element 44 and the conductive strips 41*a*, 41*b*. (However, it is understood that no dielectric material need be disposed between the planar radiating element 44 and the conductive strips 41*a*, 41*b*.) A preferred dielectric material is a multi-cellular dielectric material (i.e., a foamed material). Exemplary multicellular dielectric materials include STYROFOAM® brand multi-cellular expanded synthetic resins, available from the Dow Chemical Company, Midland, Mich.

In the illustrated embodiment of FIG. 5, the distance Z between the planar radiating element 44 and the conductive strips 41*a*, 41*b* is preferably maintained at between about three millimeters and about nine millimeters (3 mm–9 mm) by the dielectric material 45. However, the radiating element 44 may be spaced apart from the conductive strips by an amount less than 3 mm and greater than 9 mm.

Preferably, the planar radiating element 44 and the pair of conductive strips 41*a*, 41*b* are in substantially parallel relationship. The term "substantially parallel" is understood to mean "approximately parallel", such as within plus or minus thirty degrees 30° of being parallel.

The illustrated planar radiating element 44 includes first and second meandering segments 46*a*, 46*b*. The first and second meandering segments 46*a*, 46*b* have "mirror image" meandering configurations and are connected together in opposing relationship therewith to form a continuous, planar, conductive loop, as illustrated. The first and second meandering segments 46*a*, 46*b* each include a respective set of periodically spaced-apart undulations 47*a*, 47*b*. In the illustrated embodiment, each of the periodically spaced-apart undulations 47*a*, 47*b* has a U-shaped configuration. However, the first and second meandering segments 46*a*, 46*b* may have virtually any type of undulation and are not limited to the illustrated U-shaped undulations.

Figure 6:
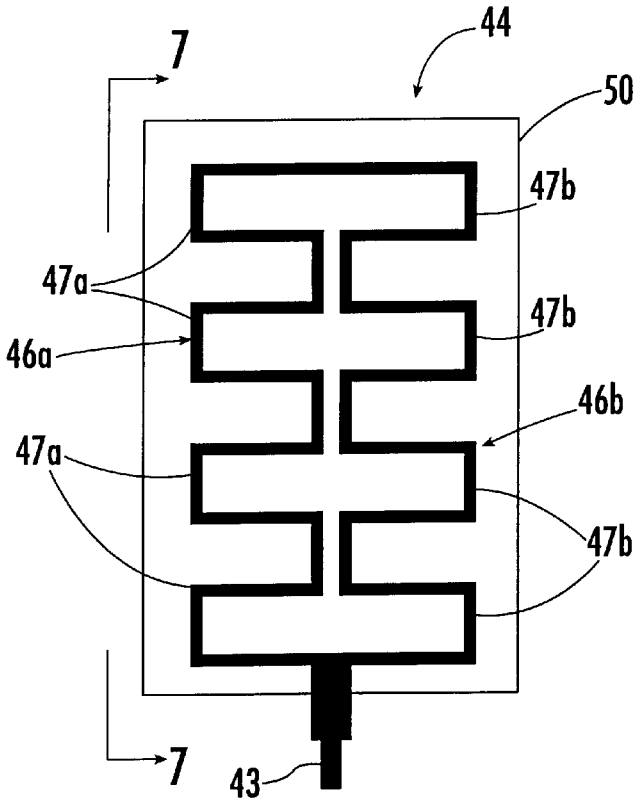
FIG. 6 is a top plan view of a radiating element with mirror image meandering segments disposed on a substrate according to another embodiment of the present invention.

According to another embodiment, illustrated in FIG. 6, the planar radiating element 44 may be disposed (e.g., etched) on a dielectric substrate 50 as a copper (or other conductive material) trace. An exemplary material for use as a dielectric substrate 50 is FR4 or polyimide, which is well known to those having skill in the art of communications devices. However, various other dielectric materials also may be utilized. Preferably, the dielectric substrate 50 has a dielectric constant between about 2 and about 4. However, it is to be understood that dielectric substrates having different dielectric constants may be utilized without departing from the spirit and intent of the present invention.

Figure 7:
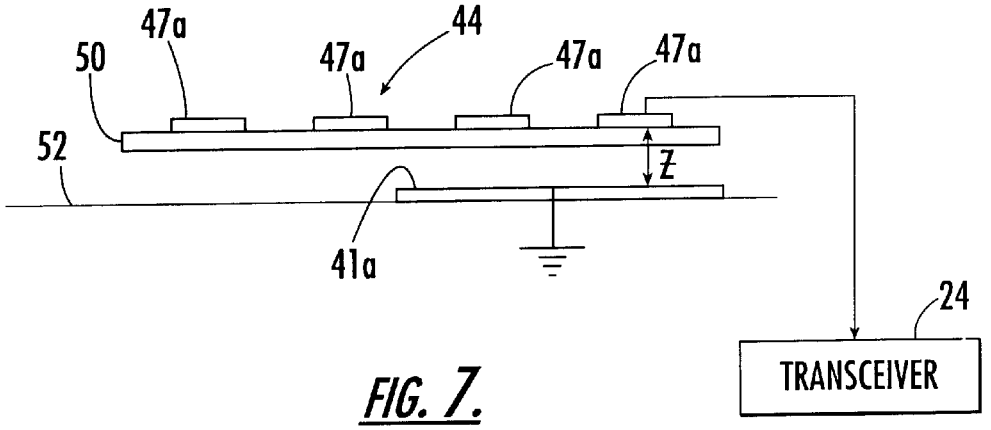
FIG. 7 is a side elevation view of the radiating element of FIG. 6 taken along lines 7—7 in spaced-apart relationship with a pair of conductive strips.

Referring now to FIG. 7, the dielectric substrate 50 of FIG. 6, having a planar radiating element 44 disposed thereon as a conductive trace, is illustrated in an exemplary spaced-apart configuration within a wireless communications device, such as a radiotelephone. Conductive strips (41*a* illustrated), which serve as parasitic elements, are etched on a substrate 52, such as a printed circuit board (PCB) as copper traces (or traces of other conductive material). The planar radiating element 44 is electrically connected to a transceiver 24 and the conductive strips (41*a* illustrated) are connected to ground.

A preferred conductive material out of which the planar radiating element 44 may be formed is copper. For example, the planar radiating element 44 illustrated in FIGS. 4 and 5 may be formed from copper wire. Alternatively, the planar radiating element 44 may be a copper trace disposed on a substrate, as illustrated in FIG. 6. However, a planar radiating element 44 according to the present invention may be formed from various conductive materials and is not limited to copper.

The radiating element 44 illustrated in FIGS. 4 and 5 is printed using one-half ounce (½ oz.) copper. The planar radiating element 44 in each of the above-illustrated embodiments may have various thicknesses and is not limited to a particular thickness.

Figure 8:
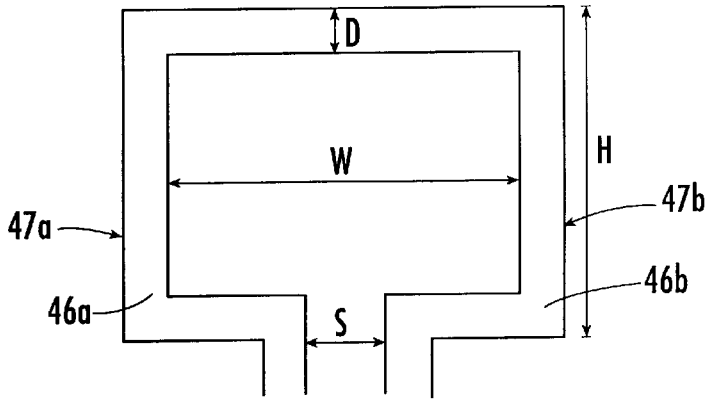
FIG. 8 is a top plan view of two opposing U-shaped undulations of a radiating element according to an embodiment of the present invention.

Referring to FIG. 8, the width D of each meandering segment 46*a*, 46*b* is preferably between about 0.25 mm and about 0.50 mm. The distance W between opposing U-shaped portion 47*a*, 47*b* is preferably between about 5 mm and about 10 mm. The height H of each opposing U-shaped portion 47*a*, 47*b* is preferably between about 2 mm and about 8 mm. The minimum spacing S between the opposing meandering segments 46*a*, 46*b* is preferably between about 0.25 mm and about 1.0 mm.

Figure 9:
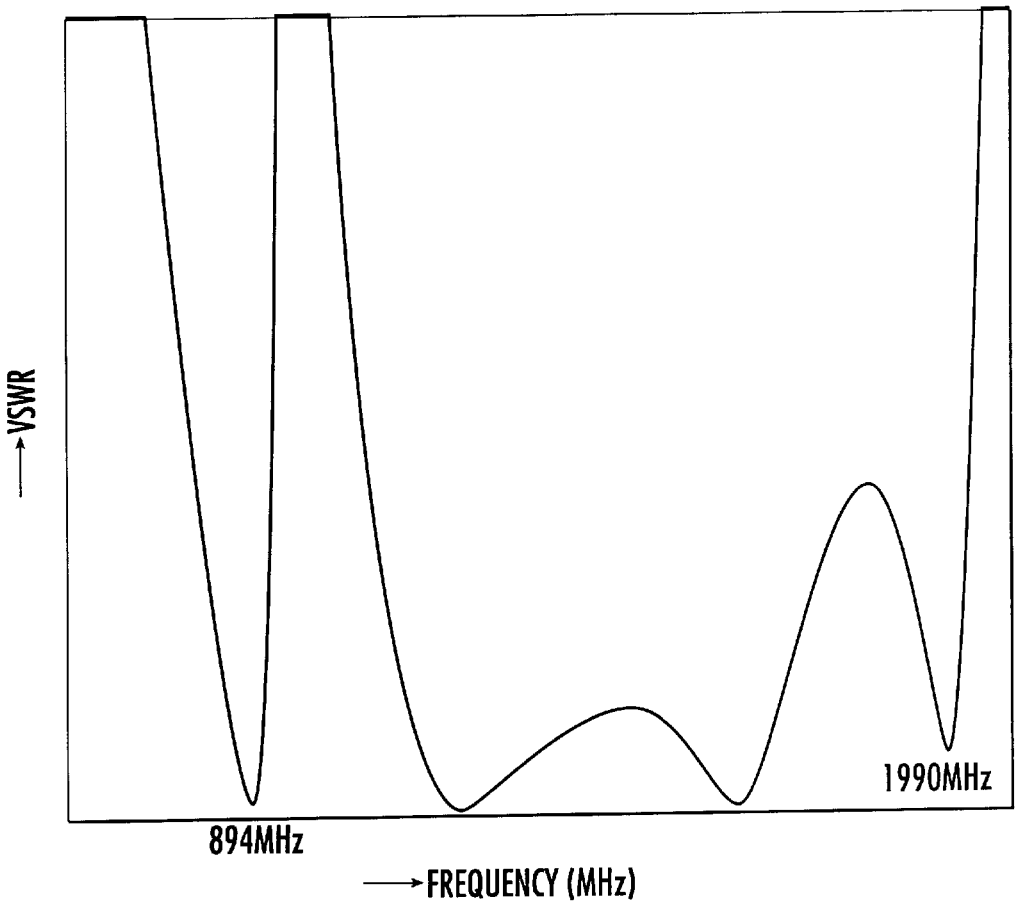
FIG. 9 is a graph of the VSWR performance of the antenna of FIGS. 4 and 6.

Referring now to FIG. 9, the illustrated antenna 40 of FIGS. 4 and 6 is configured to resonate in frequency bands of 824–894 MHz and 1850–1990 MHz. The bandwidth of the antenna 40 may be adjusted by adjusting the various dimensions described above as well by adjusting the shape of the radiating element 44, the shape and length of the conductive strips 41*a*, 41*b*, and the distance Z between the conductive strips 41*a*, 41*b* and the radiating element 44.

Antennas according to the present invention may also be used with wireless communications devices which only transmit or only receive radio frequency signals. Such devices which only receive signals may include conventional AM/FM radios or any receiver utilizing an antenna. Devices which only transmit signals may include remote data input devices.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An antenna, comprising:

a pair of adjacent, spaced-apart, substantially parallel conductive strips electrically connected to ground;

a planar radiating element overlying the pair of conductive strips and spaced-apart therefrom in substantially parallel relationship, wherein the conductive strips are configured to parasitically couple with the radiating element, and wherein the planar radiating element comprises:

a first meandering segment; and a second meandering segment that is a mirror image of the first meandering segment, and wherein the first and second meandering segments are connected together in opposing relationship therewith to form a continuous, conductive loop; and a signal feed electrically connected to the planar radiating element.

2. The antenna according to claim 1 further comprising dielectric material disposed between the conductive strips and the radiating element.

3. The antenna according to claim 1 wherein the dielectric material comprises a foamed material.

4. The antenna according to claim 1 further comprising a ground plane disposed adjacent to the radiating element, and wherein the conductive strips are electrically connected to the ground plane.

5. The antenna according to claim 1 wherein the first meandering segment comprises a first set of periodically spaced-apart planar undulations, and wherein the second meandering segment comprises a second set of periodically spaced-apart planar undulations.

6. The antenna according to claim 5 wherein the first set of periodically spaced-apart planar undulations comprises a respective plurality of periodically spaced-apart U-shaped portions, and wherein the second set of periodically spaced-apart planar undulations comprises a respective plurality of periodically spaced-apart U-shaped portions.

7. An antenna, comprising:

a pair of adjacent, spaced-apart, substantially parallel conductive strips electrically connected to ground;

a planar radiating element overlying the pair of conductive strips and spaced-apart therefrom in substantially parallel relationship, wherein the conductive strips are configured to parasitically couple with the radiating element, and wherein the planar radiating element comprises:

a first meandering segment comprising a plurality of periodically spaced-apart U-shaped portions; and a second meandering segment comprising a plurality of periodically spaced-apart U-shaped portions, wherein the second meandering segment has a configuration that is a mirror image of a configuration of the first meandering segment, and wherein the first and second meandering segments are connected together in opposing relationship therewith to form a continuous conductive loop; and a signal feed electrically connected to the planar radiating element.

8. The antenna according to claim 7 further comprising dielectric material disposed between the conductive strips and the planar radiating element.

9. The antenna according to claim 8 wherein the dielectric material comprises a foamed material.

10. A wireless communicator, comprising:

a housing configured to enclose a transceiver that transmits and receives wireless communications signals;

a ground plane disposed within the housing; and an antenna disposed within the housing and electrically connected with the transceiver, wherein the antenna comprises:

a pair of adjacent, spaced-apart, substantially parallel conductive strips electrically connected to the ground plane;

a planar radiating element overlying the pair of conductive strips and spaced-apart therefrom in substantially parallel relationship, wherein the conductive strips are configured to parasitically couple with the radiating element, and wherein the planar radiating element comprises:

a first meandering segment; and a second meandering segment that is a mirror image of the first meandering segment, and wherein the first and second meandering segments are connected together in opposing relationship therewith to form a continuous conductive loop; and an RF signal feed that electrically connects the planar radiating element with the transceiver.

11. The wireless communicator according to claim 10 further comprising dielectric material disposed between the conductive strips and the radiating element.

12. The wireless communicator according to claim 10 wherein the dielectric material comprises a foamed material.

13. The wireless communicator according to claim 10 wherein the first meandering segment comprises a first set of periodically spaced-apart, planar undulations, and wherein the second meandering segment comprises a second set of periodically spaced-apart, planar undulations.

14. The wireless communicator according to claim 13 wherein the first set of periodically spaced-apart, planar undulations comprise a respective plurality of periodically spaced-apart U-shaped portions, and wherein the second set of periodically spaced-apart, planar undulations comprise a respective plurality of periodically spaced-apart U-shaped portions.

15. The wireless communicator according to claim 10 wherein the wireless communicator comprises a radiotelephone.

16. A wireless communicator, comprising:

a housing configured to enclose a transceiver that transmits and receives wireless communications signals;

a ground plane disposed within the housing; and an antenna disposed within the housing and electrically connected with the transceiver, wherein the antenna comprises:

a pair of adjacent, spaced-apart, substantially parallel conductive strips electrically connected to ground;

a planar radiating element overlying the pair of conductive strips and spaced-apart therefrom in substantially parallel relationship, wherein the conductive strips are configured to parasitically couple with the radiating element, and wherein the planar radiating element comprises:

a first meandering segment comprising a plurality of periodically spaced-apart U-shaped portions; and a second meandering segment comprising a plurality of periodically spaced-apart U-shaped portions, wherein the second meandering segment has a configuration that is a mirror image of a configuration of the first meandering segment, and wherein the first and second meandering segments are connected together in opposing relationship therewith to form a continuous conductive loop; and a signal feed electrically connected to the planar radiating element.

17. The wireless communicator according to claim 16 further comprising dielectric material disposed between the conductive strips and the planar radiating element.

18. The wireless communicator according to claim 17 wherein the dielectric material comprises a foamed material.

19. The wireless communicator according to claim 16 wherein the wireless communicator comprises a radiotelephone.

* * * * *